US005178928A

United States Patent [19]

Goto et al.

[11] Patent Number: 5,178,928

[45] Date of Patent: Jan. 12, 1993

[54] DECORATIVE MATERIALS

[75] Inventors: Hideo Goto; Osamu Takeko; Hiroshi Tanaka, all of Tokyo, Japan

[73] Assignee: Dai Nippon Insatsu Kabushiki Kaisha, Tokyo, Japan

[21] Appl. No.: 411,383

[22] Filed: Sep. 22, 1989

[30] Foreign Application Priority Data

| | | | |
|---|---|---|---|
| Sep. 22, 1988 | [JP] | Japan | 63-237949 |
| Oct. 11, 1988 | [JP] | Japan | 63-255393 |
| Oct. 13, 1988 | [JP] | Japan | 63-258257 |
| Oct. 18, 1988 | [JP] | Japan | 63-262614 |

[51] Int. Cl.[5] ..... B44C 5/06; E04F 13/00

[52] U.S. Cl. ..... 428/106; 428/151; 428/195; 428/904.4

[58] Field of Search ..... 428/106, 195, 151, 904.4

[56] References Cited

U.S. PATENT DOCUMENTS

| | | | |
|---|---|---|---|
| 1,904,718 | 4/1933 | Cochrane, Jr. et al. | 428/106 |
| 3,542,641 | 11/1970 | Showalter et al. | 428/106 X |
| 4,731,145 | 3/1988 | Senzani | 428/106 X |
| 4,888,220 | 12/1989 | Mehta | 428/106 X |

*Primary Examiner*—Henry F. Epstein

[57] ABSTRACT

A decorative material in which two layers, i.e., a delustering printed layer and a lustering printed layer are combined together in a particular manner to obtain rugged feeling close to that of a natural tree. The lustering printed layer is formed on the grain trachea pattern portion so as to cover the trachea pattern, in order to obtain appearance that resembles natural tracheae, yet improving abrasion resistance and durability.

11 Claims, 4 Drawing Sheets

DECORATIVE MATERIALS

BACKGROUND OF THE INVENTION

The present invention relates to decorative materials used as surface materials for furniture, household things, wall materials and the like. More specifically, the present invention relates to decorative materials with grain patterns rich in three-dimensional appearance that highly resemble natural trees, featuring design character of high quality.

Decorative sheets having printed patterns resembling grain patterns of natural trees have been extensively utilized as surface materials for furniture, household things and wall materials. For example, there has been known a decorative sheet obtained by forming a transparent resin coating layer having luster on the whole surface of a grain printed pattern of a starting paper of decorative sheet that has the grain printed pattern formed by imparting grain printed pattern on the starting paper for decoration, and then forming a delustering printed layer that corresponds to grains and tracheae on some portions of the transparent resin coating layer. There has also been known a decorative sheet (Japanese Patent Publication No. 331/1978) obtained by forming a delustering printed layer that corresponds to the grain tracheae and a lustering printed layer that corresponds to non-trachea portion other than the delustering printed layer on the starting paper for decorative sheet that has a grain printed pattern formed by imparting the grain printed pattern to the starting paper for decoration.

Between the above-mentioned conventional decorative sheets, the decorative sheet obtained by forming the delustering printed layer that corresponds to the grains and tracheae on some portions of the transparent resin coating layer has a trachea pattern of a delustering ink on the uppermost surface of the decorative sheet. Therefore, the trachea pattern does not give impression on recessed portions. Moreover, since only two kinds of lusters are expressed on the decorative sheet, the appearance is monotonous and lacks real grain pattern of a natural tree. Furthermore, the conventional decorative sheet does not have sufficient resistance against abrasion at the trachea portions.

Sufficient resistance against abrasion is not obtained, either, at the trachea pattern portions in the case of the latter conventional decorative sheet that has the delustering printed layer corresponding to the grains and tracheae and the lustering printed layer that corresponds to non-trachea portions other than the delustering printed layer. Moreover, only two kinds of lusters are expressed on the decorative sheet, and the appearance is monotonous. Furthermore, since the lustering printed pattern portion and the delustering printed pattern portion are in negative and positive relationship, the underlying pattern is exposed when the register of printing is deviated. Therefore, the surface characteristics of the exposed portions are deteriorated, and add texture stemming from the exposure of the underlying pattern deteriorates the effects of design.

SUMMARY OF THE INVENTION

The present invention was accomplished in view of the problems inherent in the aforementioned conventional art, and its object is to provide decorative materials that have appearance very close to grain patterns of a natural tree, that have excellent resistance against abrasion at the trachea patterns in the grain patterns, and that exhibit excellent durability.

The above object is achieved by the decorative materials of the present invention in which the two layers, i.e., the delustering printed layer and the lustering printed layer, are combined in a particular manner to produce rugged appearance close to that of a natural tree, and the lustering printed layer is formed on the portions of the grain trachea patterns only so as to cover the trachea patterns to produce appearance close to natural tracheae, yet improving abrasion resistance and durability.

DETAILED DESCRIPTION OF THE PREFERRED EMBODIMENT

First and second embodiments

The first invention provides a decorative material in which the trachea pattern portions are recessed, and the delustering viewed from the external side is divided into three degrees to provide high degree of design effects that stem from high reality relative to the grain patterns of natural trees. Moreover, even when the register of printing is deviated to some extent, odd texture does not develop and the design effects are not deteriorated. Furthermore, the trachea pattern that is most conspicuous among the grain patterns is not exposed on the surface of the decorative material, and excellent abrasion resistance is maintained.

The second invention provides a decorative material in which the trachea portions are recessed, and the delustering viewed from the external side is divided into four degrees to provide very high degree of design effects that stem from high reality relative to the grain patterns of natural trees. Moreover, even when the register of printing is deviated to some extent, odd texture does not develop and the design effects are not deteriorated. Furthermore, the trachea pattern that is most conspicuous among the grain patterns is not exposed on the surface of the decorative material, and excellent abrasion resistance is maintained.

Figure 1:
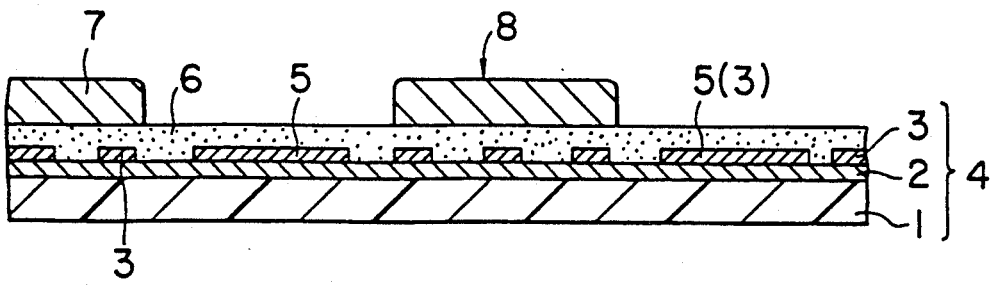
FIGS. 1 to 6, 9 and 10 are section views of decorative materials according to the present invention.

That is, the decorative material according to the first invention comprises as shown in FIG. 1:

a decorative material substrate 4 having a grain printed pattern 3 inclusive of a first printed layer 5 that has a color and a contour resembling grain tracheae;

a transparent or semitransparent delustering underprinted layer 6 formed on the whole surface of the grain printed pattern 3 of the decorative material substrate 4; and a second printed layer 7 consisting of a transparent or semitransparent lustering pattern, said second printed layer 7 having an outer contour located outside said first printed layer 5 in the horizontal direction maintaining a gap relative to outer contour of said first printed layer along the outer contour of said first printed layer, said second printed layer 7 being formed on said delustering underprinted layer 6 in the vertical direction on the zones except the zones of said first printed layer 5, and said second printed layer 7 being greatly protruded beyond said delustering underprinted layer 6.

Figure 2:
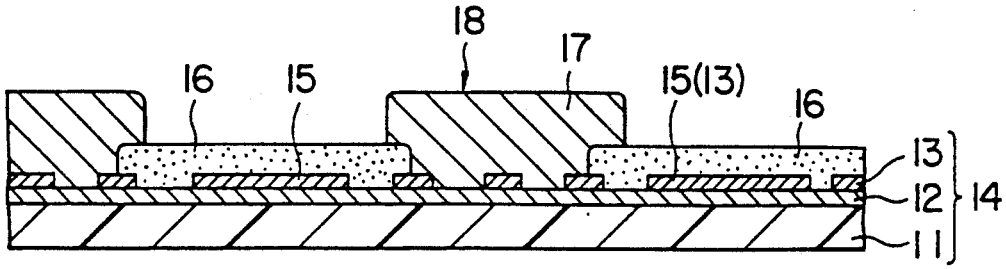

The decorative material according to the second invention comprises as shown in FIG. 2:

a decorative material substrate 14 having a grain printed pattern 13 inclusive of a first printed layer 15 that has a color and a contour resembling grain tracheae;

a transparent or semitransparent delustering underprinted layer 16 which is locally formed to completely cover said first printed layer 15, said delustering underprinted layer 16 having an outer contour located on the outside of said first printed layer 15 in the horizontal direction maintaining a gap relative to the outer contour of said first printed layer 15 along the outer contour of said first printed layer 15; and a second printed layer 17 consisting of a transparent or semitransparent lustering pattern, said second printed layer 17 having an outer contour which is located on said delustering underprinted layer 16, which is located on the outside of said first printed layer 15 in the horizontal direction maintaining a gap relative to the outer contour of said first printed layer 15 along the outer contour of said first printed layer 15, said second printed layer 17 being formed on said delustering underprinted layer 16 through up to the grain printed pattern other than the grain tracheae on the zones except the zone of said first printed layer 15, and said second printed layer 17 being greatly protruded beyond said delustering underprinted layer 16.

In the decorative materials of the first and second inventions, furthermore, further distinguished effects are obtained if the ratio B/A is set to lie within a range of from 1.1 to 2.0, wherein A denotes a width of the first printed layer 5(15) and B denotes a distance between the second printed layers 7(17) (distance from the outer contour to another outer contour) that are located via the first printed layer 5(15).

The first printed layer resembling the grain tracheae in the decorative materials of the invention is formed in a vertically elongated shape. The printed patterns such as the grain printed pattern including the first printed layer resembling the grain tracheae, delustering underprinted layer and the second printed layer, are printed on the decorative material substrate by, for example, the silk screen method or the gravure offset method. Examples of the decorative material substrate include papers such as tissue paper, bleached craft paper, linter paper, and the like; plastic films such as polyvinyl chloride film, polyethylene film, polyethylene terephthalate film, and the like films; metal foils such as copper, aluminum and iron; wood-type substrates such as sheet, wood, plywood, particle board, and the like; gypsum-type substrates such as gypsum board, gypsum slag board, and the like; fiber-containing cement boards such as pulp cement board, asbestos cement board, wood piece cement board; GRC and concrete; metal plates such as of copper, aluminum, iron and the like; and laminates of two or more kinds of the above-mentioned sheets and plates.

From the standpoint of cost and printability, the most desired examples of the decorative material substrate is a tissue paper (thin paper) of a packing density of 20 to 70 g/m$^2$ or a polyvinyl chloride film having a thickness of 50 to 300 μm containing 5 to 35 parts by weight of a plasticizer.

When a film-like or sheet-like decorative material substrate is to be used, the decorative material of the present invention is laminated on a general decorative material substrate to form a desired decorative material. There can be used decorative material substrates such as wood-type substrates, e.g., wood, plywood, particle board, etc.; gypsum-type substrates e.g., gypsum board, gypsum slag board, etc.; fiber-containing cement boards, e.g., pulp cement board, asbestos cement board, wood piece cement board, etc.; GRC and concrete; metal sheets or metal plates such as of iron, aluminum, copper, etc.; and composite boards consisting of the above-mentioned substrates.

The printed patterns to be imparted to the decorative material substrate are usually printed by, for example, the silk screen method or the gravure offset method on a base coat layer that is directly printed on the whole surface of the decorative material substrate to impart concealing property.

The grain printed pattern is formed using an ordinary printing ink or a crosslinked cure-type ink.

The grain printed pattern without the trachea portion formed on the decorative material substrate may have the first printed layer, i.e., the trachea portion, formed thereon.

The first printed layer in the decorative materials of the invention has a color and contour that resemble the tracheae of natural trees.

Further, the first printed layer may be delustered or may have luster, and there is no particular limitation to the luster in the first printed layer.

The transparent or semitransparent delustering underprinted layer formed on the decorative material of the present invention has patterns printed thereon using a colorless or a colored transparent printing ink containing an inorganic pigment which is a delustering agent. Like other printed layers, the transparent or semitransparent delustering underprinted layer is formed using a printing ink which uses, as a vehicle component, a cellulose derivative such as ethyl cellulose, nitrocellulose, ethylhydroxyethyl cellulose, cellulose acetate propionate, cellulose acetate butylate, cellulose acetate, or the like; a styrene resin or a styrene copolymeric resin such as polystyrene, poly-α-methyl styrene, or the like; acrylic or methacrylic monomeric or copolymeric resin such as methyl polymethacrylate, ethyl polymethacrylate, ethyl polyacrylate, butyl polyacrylate, or the like; a rosin ester resin such as rosin, rosin-modified maleic acid resin, rosin-modified phenolic resin, polymerized rosin, etc.; a vehicle resin for general inks such as polyvinyl acetate resin, Cumaron-Kunstharz, vinyl toluene resin, vinyl chloride resin, polyester resin, polyamide resin, or butyral resin; or a curing resin such as alkyd resin, butylated aminoaldehyde resin, phenolic resin, phthalic acid-type resin, epoxy-type resin, urethane-type resin, melamine resin, unsaturated polyester resin, or polysiloxane-type resin, the printing ink further containing, as required, a hardening agent, a catalyst, a dyestuff and a pigment.

In the decorative material of the present invention, furthermore, the second transparent or semitransparent lustering printed layer is partly formed as a colorless or colored transparent printed layer, and has a surface greatly protruded beyond the above-mentioned transparent or semitransparent delustering underprinted layer.

The distance from the surface of the second printed layer to the surface of the transparent or semitransparent delustering underprinted layer is usually about 1 to 10 μm.

In the decorative materials of the present invention, furthermore, the first printed layer and the second printed layer that are never overlapped in the vertical direction, i.e., that are formed maintaining a gap relative to each other in the direction of plane, have a ratio B/A of 1.1 to 2.0, and preferably 1.1 to 1.5, wherein A denotes the width of the first printed layer and B denotes a distance between a pair of second printed layers opposed to each other via the first printed layer (distance from an outer contour to another outer contour). When the ratio B/A lies within the above range, there is obtained an ideal decorative material that resembles the grain pattern of natural trees.

When the distance is about 50 to 500 μm from the outer contour of the first printed layer to the outer contour of the second printed pattern in the horizontal direction, it has been confirmed that a dividing line that exists between the outer contour of the first printed layer and the outer contour of the second printed pattern exhibits a clear edge effect relative to the first printed layer.

In the decorative material of the second invention, furthermore, when the distance in the direction of plane is about 50 to 500 μm from the outer contour of the transparent or semitransparent delustering underprinted layer to the outer contour of the second printed layer, i.e., when the width of a portion where the second printed layer overlaps the transparent or semitransparent delustering underprinted layer is about 50 to 500 μm, it has been confirmed that a design effect is exhibited by the presence of the overlapped portion.

In the decorative materials of the present invention, furthermore, the portions serving as a delustering printed layer are formed using a delustering ink or, concretely speaking, using a printing ink that contains a delustering agent or inorganic pigment such as $CaCO_3$, $Al_2O_3$, $SiO_2$ or the like in a suitable amount.

In the decorative materials of the present invention, furthermore, the printed layers that will be exposed, i.e., the transparent or semitransparent delustering underprinted layer and the second printed layer should be formed using a crosslinked curing ink such as an ionizing radiation curing ink that will be cured upon irradiation with an ionizing radiation having energy quantum sufficient for crosslinking and polymerizing the molecules among the electromagnetic waves and charged particle rays, using a two-liquid reaction type curing ink, or using a heat curing ink, in order to improve physical and mechanical properties on the surface of the decorative materials.

Though there is no particular limitation to the resin vehicles in the crosslinked curing ink that is used, the following resins can be used. Ionizing radiation curing resins:

Prepolymers or oligomers containing an ethylenically unsaturated bond in the molecules, such as unsaturated polyesters; various acrylates such as polyester acrylate, epoxy acrylate, urethane acrylate, polyether acrylate, polyol acrylate and melamine acrylate; one or two or more of methacrylates such as polyester methacrylate, polyether methacrylate, polyol methacrylate, and melamine methacrylate, and styrene monomers having an ethylenically unsaturated bond in the molecules such as styrene, α-methyl styrene, and the like; acrylic esters such as methyl acrylate, 2-ethylhexyl acrylate, methoxyethyl acrylate, butoxyethyl acrylate, butyl acrylate, methoxybutyl acrylate, and phenyl acrylate; methacrylic esters such as ethyl methacrylate, propyl methacrylate, methoxyethyl methacrylate, ethoxymethyl methacrylate, phenyl methacrylate, and lauryl methacrylate; unsaturated carboxylic acid amides such as acrylamide and methacrylamide; substituted aminoalcohol diethylamino)ethyl acrylate, 2-(N,N-dimethylamino)ethyl methacrylate, 2-(N,N-dibenzylamino)ethyl acrylate, (N,N-dimethylamino)methyl methacrylate, and 2-(N,N-diethylamino)propyl acrylate; polyfunctional compounds such as ethyleneglycol diacrylate, propyleneglycol diacrylate, neopentylglycol diacrylate, 1,6-hexanediol diacrylate, diethylene glycol diacrylate, triethyleneglycol diacrylate, dipropyleneglycol diacrylate, ethyleneglycol acrylate, propyleneglycol dimethacrylate, diethyleneglycol dimethacrylate, and the like; and (or) polythiol compounds having two or more thiol groups in the molecules, such as trimethylolpropane trithioglycolate, trimethylolpropane trithiopropylate, pentaerythritol tetrathioglycol, and the like. Two-liquid reaction curing type resins:

Polyurethanes using isocyanate as a curing agent, unsaturated polyester-type resins, and epoxy-type resins using amine as a curing agent. Heat curing resins:

Polysiloxanes and the like.

The aforementioned materials are also used even in other embodiments of the present invention that will be described hereinafter.

Third and fourth embodiments

The third invention provides a decorative material in which the trachea pattern portions are recessed, and the delustering viewed from the external side is divided into three degrees to provide high degree of design effects that stem from high reality relative to the grain patterns of natural trees. Moreover, even when the register of printing is deviated to some extent, odd texture does not develop and the design effects are not deteriorated. Furthermore, the trachea pattern that is most conspicuous among the grain patterns is not exposed on the surface of the decorative material, and excellent abrasion resistance is maintained.

The fourth invention provides a decorative material in which the trachea portions are recessed, and the delustering viewed from the external side is divided into four degrees to provide very high degree of design effects that stem from high reality relative to the grain patterns of natural trees. Moreover, even when the aim of printing is deviated to some extent, odd texture does not develop and the design effects are not deteriorated. Furthermore, the trachea pattern that is most conspicuous among the grain patterns is not exposed on the surface of the decorative material, and excellent abrasion resistance is maintained.

Figure 3:
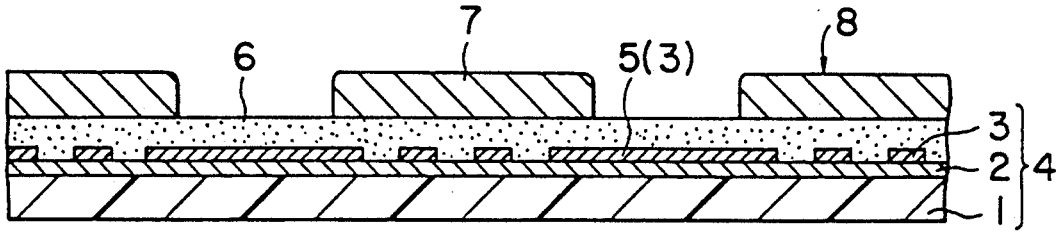

That is, the decorative material according to the third invention comprises as shown in FIG. 3:

a decorative material substrate 4 having a grain printed pattern 3 inclusive of a first printed layer 5 that consists of a delustering pattern having a color and a contour resembling grain tracheae;

a transparent or semitransparent delustering underprinted layer 6 formed on the whole surface of the grain printed pattern 3 of the decorative material substrate 4; and a second printed layer 7 consisting of a transparent or semitransparent lustering pattern formed on said delustering underprinted layer 6.

In the decorative material of the third invention, the second printing layer 7 has an outer contour that is located on the first printed layer 5 maintaining a gap relative to the outer contour of the first printed layer 5 in the horizontal direction and running along the outer contour of the first printed layer 5. Further, the second printed layer 7 is formed on the whole zones except the zone surrounded by the outer contour of the second printed layer 7 which is located on the first printed layer 5 via the delustering underprinted layer 6, the second printed layer 7 being greatly protruded beyond the first printed layer 5.

Figure 4:
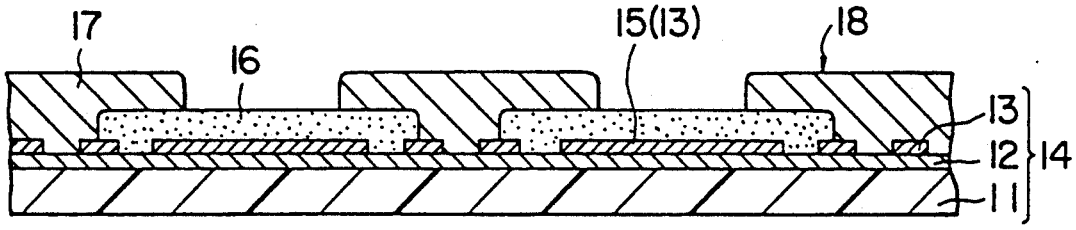

The decorative material according to the fourth invention comprises as shown in FIG. 4:

a decorative material substrate 14 having a grain printed pattern 13 inclusive of a first printed layer 15 consisting of a delustering pattern that has a color and a contour resembling grain tracheae;

a transparent or semitransparent delustering underprinted layer 16 that is partly formed to cover the first printed layer 15 of the decorative material substrate 14; and a second printed layer 17 consisting of a transparent or semitransparent lustering pattern formed on said delustering underprinted layer 16 through up to the grain pattern 13 in the decorative material substrate 14.

In the decorative material of the fourth invention, the outer contour of the delustering underprinted layer 16 is located on the grain printed pattern 13 of the decorative material substrate 14 maintaining a gap relative to the outer contour of the first printing layer 15 and running along the outer contour of the first printed layer 15. Further, the outer contour of the second printed layer 17 is located on the first printed layer 15 maintaining a gap in the horizontal direction relative to the outer contour of the first printed layer 15 and running along the outer contour of the first printed layer 15. The second layer 17 is formed on the whole zones except the zone surrounded by the outer contour of the second printed layer 17 which is positioned on the first printed layer 16 via the delustering underprinted layer 16, the second printed layer 17 being greatly protruded beyond the first printed layer 15.

In the decorative materials constructed according to the third and fourth inventions, furthermore, more excellent effects are obtained when the ratio B/A is set to lie within a range of from 0.1 to 0.9, wherein A denotes a width of the first printed layer 5(15) and B denotes a distance between a pair of second printed layers 7(17) opposed to each other via the first printed layer 5(15) (a distance from an outer contour to another outer contour).

Here, the distance from the surface of the second printed layer 7(17) to the surface of the transparent or semitransparent delustering underprinted layer 6(16) should usually be about 1 to 20 μm.

According to the third and fourth inventions in which the first printed layer and the second printed layer are formed being partly overlapped in the vertical direction, it has been confirmed that the decorative materials can be obtained having ideal printed patterns resembling the grain patterns of a natural tree when the ratio B/A of a distance B between the contours of the second printed layers on the first printed layer to a width A of the first printed layer, lies from 0.1 to 0.9 and, preferably, from 0.5 to 0.9.

When the distance is about 50 to 500 μm from the outer contour of the first printed layer to the outer contour of the second printed layer in the horizontal direction, i.e., when the distance is about 50 to 500 μm over a portion on which they are superposed in the horizontal direction, it has been confirmed that the edge effect is clearly exhibited relative to the first printed layer owing to a dividing line that exists between the outer contour of the first printed layer and the outer contour of the second printed layer.

In the decorative material of the fourth embodiment, furthermore, it has been confirmed that the design effect is exhibited owing to the presence of a zone where the second printed layer overlaps the delustering underprinted layer outside the first printed layer when the distance is about 50 to 500 μm in the direction of plane between the outer contour of the first printed layer and the outer contour of the transparent or semitransparent delustering underprinted layer, i.e., when the width of zone of the transparent or semitransparent delustering underprinted layer is about 50 to 500 μm that extends relative to the first printed layer.

Fifth and sixth embodiments

Next, the fifth invention provides a decorative material which gives an impression that the trachea pattern portions are recessed, the delustering viewed from the external side is divided into four degrees and one side of the grain trachea portion is more deeply recessed than the other to provide high degree of design effects that stem from high reality relative to the grain patterns of natural trees. Moreover, even when the register of printing is deviated to some extent, queer appearance does not develop and the design effects are not deteriorated. Furthermore, the trachea pattern that is most conspicuous among the grain patterns is not exposed on the surface of the decorative material, and excellent abrasion resistance is maintained.

The sixth invention provides a decorative material which gives an impression that the trachea pattern portions are recessed, the delustering viewed from the external side is divided into five degrees and one side of the grain trachea portion is more deeply recessed than the other to provide very high degree of design effects that stem from further increased reality relative to the grain patterns of natural trees. Moreover, even when the aim of printing is deviated to some extent, odd texture does not develop and the design effects are not deteriorated. Furthermore, the trachea pattern that is most conspicuous among the grain patterns is not exposed on the surface of the decorative material, and excellent abrasion resistance is maintained.

Figure 5:
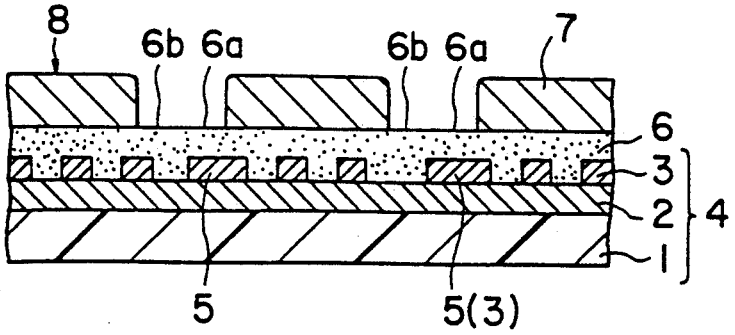

As shown in FIG. 5, the decorative material according to the aforementioned fifth invention comprises a decorative material substrate 4 having a grain printed pattern 3 that includes a first printed layer 5 of a vertically elongated shape to express the grain conduit portion, a transparent or semitransparent delustering underprinted layer 6 formed on the whole surface of the grain printed pattern 3 of the decorative material substrate 4, and a second printed layer 7 consisting of a transparent or semitransparent lustering pattern formed on the transparent or semitransparent delustering underprinted layer 6.

In the decorative material of the fifth invention, the second printed layer 7 is formed on the whole zones except a zone of the vertically elongated shape on either the right or left side of the first printed layer 5 and except a zone of the vertically elongated shape that is continuous to the above zone in the direction of width. The second printed layer 7 is greatly protruded beyond the delustering underprinted layer 6.

Figure 6:
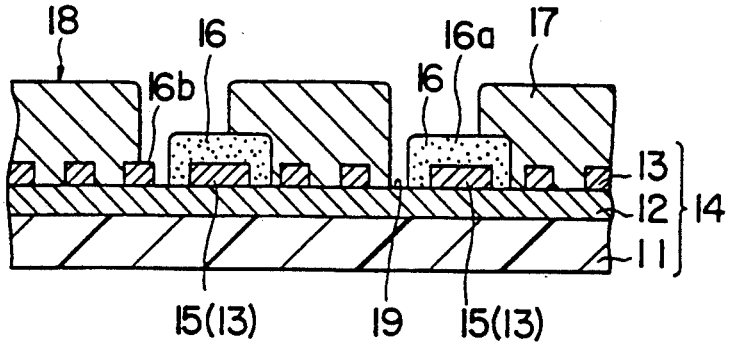

The decorative material of the sixth invention comprises as shown in FIG. 6 a decorative material substrate 14 having a grain printed pattern 13 inclusive of a first printed layer 15 of the vertically elongated shape to express the grain trachea portion, a transparent or semitransparent delustering underprinted layer 16 which is partly formed on the grain printed pattern 13 of the decorative material substrate 14 so as to cover the first printed layer 15, the outer contour of the underprinted layer 16 being located on the outside of the first printed layer 15 and along the outer contour of the first printed layer 15, and a second printed layer 17 consisting of a transparent or semitransparent lustering pattern formed spanning across the transparent or semitransparent delustering underprinted layer and the grain printed pattern 13 of the decorative material substrate 14.

In the decorative material of the sixth invention, the second printed layer 17 is formed being greatly protruded beyond the delustering underprinted layer 16 on the whole zones except the vertically elongated zones inclusive of a portion that exceeds the zone of the transparent or semitransparent delustering underprinted layer 16 and that is continuous in the direction of width to the vertically elongated zone on either the right side or the left side of the first printed layer 15.

In the structure of the decorative material of the fifth or sixth invention, the ratio B/A is set to be from 0.1 to 2.0 wherein A denotes the width of the first printed layer 5(15) and B denotes the distance from the outer contour of the second printed layer 7(17) to the outer contour of the another second printed layer 7(17) that is neighboring said second printed layer 7(17) in the direction of width, i.e., B denotes the width of a zone where the second printed layer 7(17) is not formed. Further, the ratio C/B is set to lie from 0.1 to 0.9 wherein B denotes the distance from the outer contour of the second printed layer 7(17) to the outer contour of the another second printed layer 7(17) neighboring said second printed layer 7(17) in the direction of width, and C denotes the width of a portion where the second printed layer 7(17) overlaps the first printed layer 5 (15).

In the decorative material of the present invention constituted as described above, it is desired that the zone of the first printed layer 5(15) in the lengthwise direction is in agreement with the zone of a portion where no second printed layer 7(17) is formed in the lengthwise direction. However, there arises no problem even when the length of the zone without the second printed layer 7(17) is deviated from the length of the first printed layer 5(15) within a range of about 10% of the length of the first printed layer 5(15).

Figure 7:
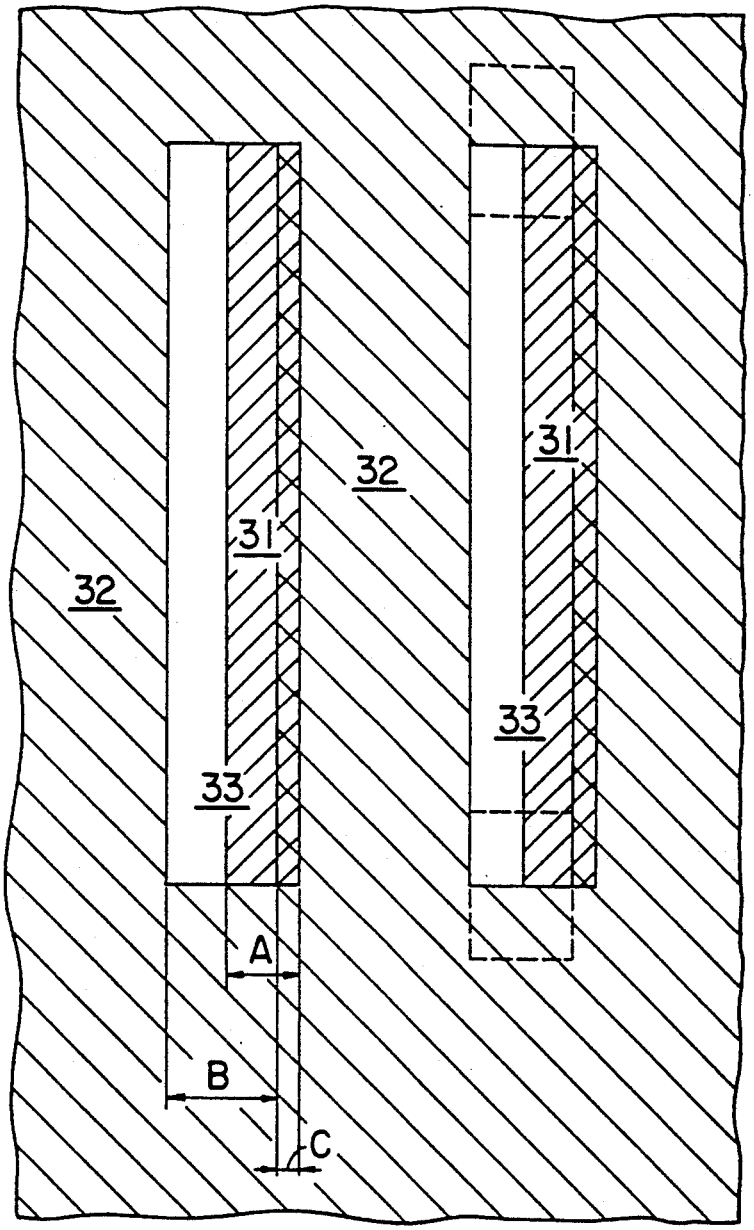
FIGS. 7 and 8 are plan views illustrating positional relationships between a first printed layer and a second printed layer in FIGS. 5 and 6.

That is, referring to FIG. 7 which illustrates a positional relationship of the first printed layer and the second printed layer in the decorative material of the present invention, there arises no problem even when the length of the zones 33, 33 without the second printed layer 32, 32 is longer than the length of the first printed layers 31, 31 by smaller than about 10%, or is shorter than the length of the first printed layers 31, 31 by smaller than about 10% as indicated by dotted lines in the drawing.

Usually, the distance of about 1 to 20 μm is sufficient from the surface of the second printed layer to the surface of the transparent or semitransparent delustering underprinted layer.

In the decorative material of the present invention, furthermore, the first printed layer and the second printed layer that are partly overlapped in the vertical direction have the following relationships to exhibit a grain pattern that is more close to that of a natural tree. That is, the ratio B/A is set to be from 0.1 to 2.0 where A denotes the width of the first printed layer and B denotes the distance from the outer contour of the second printed layer to the outer contour of the another second printed layer neighboring said second printed layer in the direction of width, and the ratio C/B is set to be from 0.1 to 0.9 where B denotes the distance from the outer contour of the second printed layer to the outer contour of the another second printed layer neighboring said second printed layer in the direction of width and C denotes the width of a portion where the second printed layer is overlapped on the first printed layer at the side portions, in order to obtain an ideal decorative material with a grain pattern closer to that of a natural tree.

In the decorative material of the sixth invention, furthermore, the distance should be about 100 to 3000 μm between the outer contour of the transparent or semitransparent delustering underprinted layer and the outer contour of the first printed layer in the direction of plane, i.e., the zone of the transparent or semitransparent delustering underprinted layer that extends relative to the first printed layer has a length of about 100 to 3000 μm in straight line.

Seventh and eighth embodiments

The seventh invention provides a decorative material in which the trachea pattern portions are recessed to a considerable degree compared with the non-trachea pattern portions, which enables the delustering degree to be freely selected, which exhibits high reality relative to the grain pattern of a natural tree to provide excellent design effects, which does not develop odd texture that deteriorates the design effects even when the register of printing is deviated to some extent, which does not permit the grain pattern that is most conspicuous among the grain patterns to be exposed to the surface of the decorative material, and which gives excellent abrasion resistance.

Further, the eighth invention provides a decorative material in which the trachea pattern portions are recessed to a considerable degree compared with the non-trachea pattern portions, .which enables the delustering degree to be freely selected, which exhibits the delustering in three degrees as viewed from the external side, which exhibits high reality relative to the grain pattern of a natural tree to provide, excellent design effects, which does not develop odd texture that deteriorates the design effects even when the aim of printing is deviated to some extent, which does not permit the grain pattern that is most conspicuous among the grain patterns to be exposed to the surface of the decorative material, and which gives excellent abrasion resistance.

Figure 9:
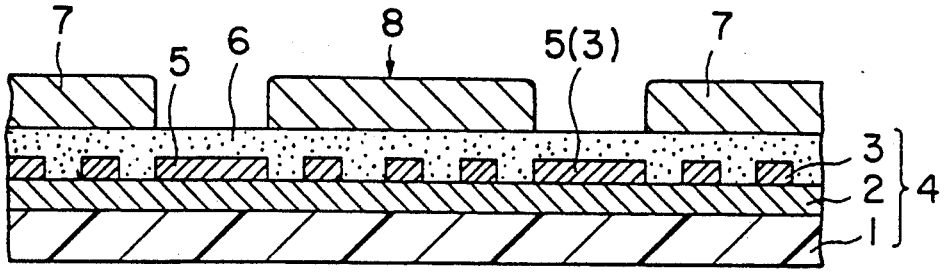

The decorative material of the seventh invention consists as shown in FIG. 9 of a grain printed pattern 3 inclusive of the first printed layer 5 with a pattern consisting of a color and a contour close to those of the grain trachea portions, the grain printed pattern 3 being applied to the surface of the decorative material substrate, a transparent or semitransparent delustering underprinted layer 6 formed on the whole surface of the grain printed pattern 3, and a second printed layer 7 consisting of a transparent or semitransparent lustering pattern formed on the delustering underprinted layer 6. The second printed layer 7 has an outer contour that overlaps the outer contour of the first printed layer 5 in the vertical direction, and is formed on the whole zones except the zone of the first printed layer 5 to greatly protrude beyond the delustering underprinted layer 6.

Figure 10:
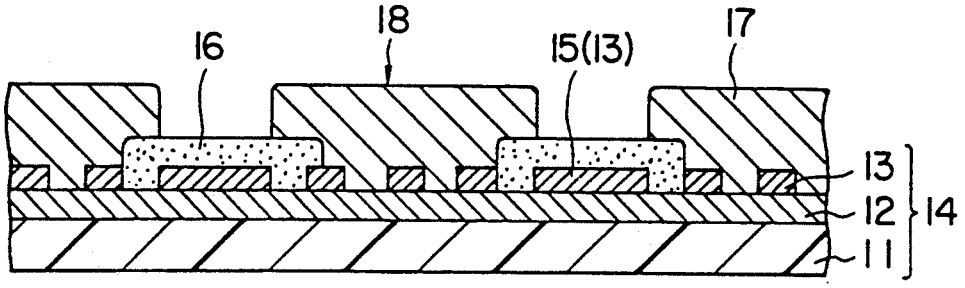

The decorative material of the eighth invention consists as shown in FIG. 10 of a grain printed pattern 13 inclusive of a first printed layer 15 with a pattern consisting of a color and a contour close to those of the grain trachea portions, the grain printed pattern 13 being applied to the surface of the decorative material substrate, a transparent or semitransparent delustering underprinted layer 16 which has an outer contour located along the outer contour of the first printed layer 15 on the outside of the first printed layer 15 and that is locally formed to completely cover the first printed layer 15, and a second printed layer 17 consisting of a transparent or semitransparent lustering pattern that is formed on the delustering underprinted layer 16 through up to the grain printed pattern 13. The second printed layer 17 has an outer contour that overlaps the outer contour of the first printed layer 15 in the vertical direction, and is formed on the whole zones except the zone of the first printed layer 15 to protrude considerably beyond the delustering underprinted layer 16.

In the decorative materials of the seventh and eighth inventions, furthermore, the second printed layer 7(17) consisting of a transparent or semitransparent lustering pattern is formed as a colorless or colored transparent printed layer on the whole zones except the zone of the first printed layer 5(15), so as to form a surface greatly protruded beyond the transparent or semitransparent delustering underprinted layer 6(16).

Usually, the distance of about 1 to 20 μm is sufficient from the surface of the second printed layer 7(17) to the surface of the transparent or semitransparent delustering underprinted layer 6(16).

In the decorative material of the eighth invention, furthermore, it has been confirmed that excellent design effects are exhibited stemming from the edge action of the zone where the second printed layer 17 overlaps the delustering underprinted layer 16 relative to the first printed layer 15 in the outer periphery of the first printed layer 15, when the distance is about 100 to 2000 μm from the outer contour of the transparent or semitransparent delustering printed layer 16 to the outer contour of the first printed layer 15, i.e., when the zone of the transparent or semitransparent delustering underprinted layer 16 that extends relative to the first printed layer 15 has a width of about 100 to 2000 μm.

Concrete constitutions of the decorative materials of the invention will now be described by way of embodiments of their production.

EXAMPLE A1

Referring to FIG. 1, a solid printed layer [SA of Showa Ink Co.] 2 was formed maintaining a thickness of 2 μm on a tissue paper 1 of 30 g/m$^2$ [Sanko Seishi Co.] by the gravure printing method, and a grain printed pattern [SAM of Showa Ink Co.] 3 having a first printed layer 5 consisting of a trachea portion was formed by the gravure printing method using gravure printing inks of three colors [SAM of Showa Ink Co.] in order to obtain a decorative material substrate 4 imparted with the grain printed pattern 3 having trachea portion 5.

Then, a delustering underprinted layer 6 was formed by the gravure printing method using a delustering clear ink [GBS Mat of Showa Ink Co.] maintaining a thickness of 2 μm on the whole surface of the grain printed pattern 3 of the decorative material substrate 4, and a second printed layer 7 that forms a lustering pattern was formed by the gravure printing method maintaining a thickness of 5 μm by way of the trachea extract printing using a clear ink [GBS Clear of Showa Ink Co.] on the delustering underprinted layer 6 maintaining a gap relative to the first printed layer 5 in the direction of plane so as not to be overlapped by each other in the vertical direction, thereby to obtain a decorative material designated at 8 in FIG. 1.

The first printed layer 5 and the second printed layer 7 are so formed that the distance lies within a range of 100 to 500 μm between their outer contours in the horizontal direction.

Further, the ratio B/A of a distance B between the pair of second printed layers 7, 7 that are neighboring to each other via the first printed layer 5 (distance from the outer contour to another outer contour) to the width A of the first printed layer 5 of the decorative material, is 1.3, and the distance is about 5 μm from the surface of the second printed layer 7 to the surface of the delustering underprinted layer 6.

EXAMPLE A2

A decorative material substrate 14 was obtained having the same constitution as the decorative material substrate 4 of the above Example A1. That is, a solid printed layer [SA of Showa Ink Co.] 12 was formed by the gravure printing method maintaining a thickness of 2 μm on a tissue paper [Sanko Seishi Co.] 11 of 30 g/m$^2$ shown in FIG. 2, and a grain printed pattern 13 having a first printed layer 15 consisting of trachea portion was formed thereon by the gravure printing method using gravure printing inks of three colors [SAM of Showa Ink Co.], thereby to obtain a decorative material substrate 14 imparted with the grain printed pattern 13 that includes a trachea portion 15.

Then, delustering underprinted layers 16, 16 were locally formed maintaining a thickness of 2 μ using the delustering clear ink [GBS Mat of Showa Ink Co.] on the grain printed pattern 13 of the decorative material substrate 14 in a manner that the outer contours thereof will not overlap the outer contours of the first printed layers 15, 15 and that the underprinted layers 16, 16 will completely cover the first printed layers 15, 15.

Thereafter, the decorative material was obtained as designated at 18 in FIG. 2 by forming a second printed layer 17 that gives a luster pattern maintaining a thickness of 10 μm by the trachea extract printing using the clear ink [GBS Clear produced by Showa Ink Co.] in a manner that the outer contour thereof was located on the delustering underprinted layer 16, that the gap between the delustering underprinted layers 16 and 16 was filled, and that it did not overlap on the first printed layer in the vertical direction.

Here, a portion where the second printed layer 17 is superposed on the delustering underprinted layer 16 of the decorative material 18 is from 200 to 800 μm, the ratio B/A of a distance B between the pair of second printed layers 17 and 17 opposed to each other via the first printed layer 15 (distance from the outer contour to another outer contour) to the width A of the first printed layer 15 is 1.3, and the distance is about 10 μm from the surface of the second printed layer 17 to the surface of the first printed layer 15.

The aforementioned decorative material (FIG. 1) of the first invention comprises a decorative material substrate having a grain printed pattern inclusive of the first printed layer that consists of a color and a contour close to those of the trachea portion, a transparent or semitransparent delustering underprinted layer formed on the whole surface of the grain printed pattern of the decorative material substrate, and a second printed layer having a transparent or semitransparent lustering pattern formed on said delustering underprinted layer on the zones except the zone of the first printed layer in a manner that the outer contour thereof maintains a gap relative to the outer contour of the first printed layer in the horizontal direction and runs along the outer contour of the first printed layer, the second printed layer being greatly protruded beyond the delustering underprinted layer.

In the decorative material of the first invention constituted as described above, the trachea portion is formed at a position corresponding to recessed portions in the surface of the decorative material, and the degree of delustering on the surface of the decorative material is varied depending upon the three portions, i.e., depending upon the first printed layer, the second printed layer, and a portion between the first printed layer and the second printed layer. Therefore, the decorative material exhibits high reality relative to the grain pattern of a natural tree and exhibits excellent design effects.

In the decorative material of the first invention, furthermore, a portion is provided where the underlying grain pattern is allowed to be exposed between the first printed layer and the second printed layer. Therefore, even when the aim of printing is deviated to some extent in the horizontal direction between the first printed layer and the second printed layer, no odd texture develops in the grain pattern and the design effects are not deteriorated. Therefore, a large allowance is offered to cope with deviation in the aim of printing, and the quality of the decorative materials can be easily controlled during the production.

In the decorative material of the first invention, furthermore, the delustering underprinted layer is formed to cover the trachea portions. Therefore, the delustering degree for the trachea pattern can be freely adjusted over a wide range, making it possible to obtain a variety kinds of decorative materials to meet the demands.

The decorative material (FIG. 2) of the second invention comprises a decorative material substrate having a grain printed pattern inclusive of a first printed layer which consists of a color and a contour close to those of a grain trachea portion, a transparent or a semitransparent delustering underprinted layer which is locally formed to completely cover the first printed layer in a manner that the outer contour thereof runs along the outer contour of the first printed layer maintaining a gap relative to the outer contour of the first printed layer in the horizontal direction, and a second printed layer having a transparent or semitransparent lustering pattern which is formed from the delustering underprinted layer through up to the grain printed pattern except the grain trachea portion on the zones except the zone of the first printed layer in the vertical direction in a manner that the outer contour is located on the delustering underprinted layer along the outer contour of the first printed layer maintaining a gap relative to the outer contour of the first printed layer in the horizontal direction, the second printed layer being greatly protruded beyond the delustering underprinted layer.

In the decorative material of the second invention constituted as described above, the trachea pattern is imparted to a position corresponding to recessed portions in the surface of the decorative material, and the delustering on the surface of the decorative material is varied in four degrees, i.e., the degree of delustering is varied depending upon the four portions, i.e., depending upon the first printed layer, the second printed layer, the portion where the second printed layer overlaps the delustering underprinted layer, and the portion where the delustering underprinted layer only is allowed to be exposed. Therefore, the decorative material exhibits high reality relative to the grain pattern of a natural tree and exhibits very high degree of design effects.

In the decorative material of the second invention, furthermore, the trachea pattern is covered with the delustering underprinted layer. Therefore, the delustering degree for the trachea pattern can be freely adjusted over a wide range, making it possible to obtain a variety kinds of decorative materials to meet the demands.

The decorative material of the second invention has the first printed layer, the second printed layer and the delustering underprinted layer that are so formed that their outer contours do not meet each other but maintain a gap relative to each other. Therefore, even when the register of printing is deviated to some extent among these printed layers, no odd texture develops in the grain pattern and the design effects are not deteriorated, presenting large allowance to cope with deviation in the register of printing and enabling the quality to be easily controlled during the production.

In the decorative materials of the present invention, furthermore, the ratio B/A of a distance B between the pair of second printed layers neighboring to each other via the first printed layer (distance from the outer contour to another outer contour) to the width A of the first printed layer, is set to lie within a range of from 1.1 to 2.0 to obtain high degree of design characteristics very close to the grain pattern of a natural tree.

In the decorative materials of the present invention, furthermore, there exists a zone composed of a delustering layer through which the underlying trachea pattern can be seen between the first printed layer that exhibits grain trachea portions and the lustering second printed layer along the outer contour of the first printed layer, and the above-mentioned zone serves as a contour zone of the first printed layer that exhibits the trachea portion. Therefore, the edge action of trachea pattern is exhibited by the contour zone, and high degree of design character is obtained even from this point of view.

EXAMPLE B1

Referring to FIG. 3, a solid printed layer [SA produced by Showa Ink Co.] 2 was formed maintaining a thickness of 3 μm on a tissue paper of 30 g/m$^2$ [produced by Sanko Seishi Co.] 1 by the gravure printing method, and a grain printed pattern [SAM produced by Showa Ink Co.] 3 inclusive of a first printing layer 5 consisting of a trachea portion having a thickness of 2 μm was formed by the gravure printing method using gravure printing inks of three colors [SAM produced by Showa Ink Co.] in order to obtain a decorative material substrate 4 composed of a starting paper for decorative sheet that has the grain printed pattern 3 with the trachea portion 5.

Then, a delustering underprinted layer 6 was formed by the gravure printing method using a polyurethane-type two-liquid reaction curing delustering clear ink [GBS Mat produced by Showa Ink Co.] maintaining a thickness of 5 μm on the whole surface of the grain printed pattern 3 of the starting paper 4 for decorative sheet, and a second printed layer 7 that forms a luster pattern was formed by the gravure printing method maintaining a thickness of 5 μm by the trachea removing printing using a polyurethane-type two-liquid curing luster clear ink [GBS Clear produced by Showa Ink Co.] on the delustering underprinted layer in a manner that the outer contour maintains a gap relative to the outer contour of the first printed layer 5 via the underprinted layer 6 in the horizontal direction, that it overlaps the first printed layer 5 in the vertical direction, and that it covers the gap between the first printed layers 5 and 5, thereby to obtain a decorative material designated at 8 in FIG. 3.

The first printed layer 5 and the second printed layer 7 are so formed that the distance between the outer contours thereof lies within a range of from 100 to 300 μm in the horizontal direction.

The ratio B/A of the distance B between a pair of second printed layers 7 and 7 neighboring each other via the first printed layer 5 (distance from one outer contour to another outer contour) to the width A of the first printed layer 5 in the decorative material 8, is 0.8, and the distance is about 5 μm from the surface of the second printed layer 7 to the surface of the delustering underprinted layer 6.

EXAMPLE B2

A starting paper 14 for decorative sheet was obtained having the same constitution as the starting paper 4 for decorative sheet of the Example B1. That is, a solid printed layer [SA produced by Showa Ink Co.] 12 was formed by the gravure printing method maintaining a thickness of 3 μm on a tissue paper of 30 g/m$^2$ [Sanko Seishi Co.] 11 shown in FIG. 2, and a grain printed pattern 13 having a trachea portion 15 which is the first printed layer was formed thereon by the gravure printing method using gravure printing inks of three colors [SAM of Showa Ink Co.] thereby to obtain a decorative material substrate 14 composed of the starting paper for decorative sheet that has the grain printed pattern 13 inclusive of the trachea portion 15 2 μm in thickness.

Then, delustering underprinted layers 16, 16 were locally formed maintaining a thickness of 5 μm using the delustering clear ink [GBS Mat produced by Showa Ink Co.]on the grain printed pattern 13 of the starting paper 14 for decorative sheet in a manner that the outer contours maintain a gap relative to the outer contours of the first printed layers 15, 15, i.e., in a manner that they extend along the outer edges of the first printed layers 15, 15.

Thereafter, the decorative material was obtained as designated at 18 in FIG. 4 by forming a second printed layer 17 that gives a lustering pattern maintaining a thickness of 12 μm by the trachea extract printing using the luster clear ink [GBS Clear produced by Showa Ink Co.] in a manner that the outer contour thereof is located on the first printing layers 15, 15 via the delustering underprinted layer 16 in the vertical direction and that the gap between the delustering underprinted layers 16 and 16 is filled.

Here, the zone where the second printed layer 17 overlaps the first printed layer 15 of the decorative material 18 has a width of 100 to 300 μm, the distance from the second printed layer to the outer contour of the first printed layer 15 in the zone of the delustering underprinted layer 16 is from 100 to 300 μm, the ratio B/A of a distance B between the pair of second printed layers 17 and 17 opposed to each other via the first printed layer 15 (distance from one outer contour to another outer contour) to the width A of the first printed layer 15 is 0.8, and the distance is about 5 μm from the surface of the second printed layer 17 to the surface of the delustering underprinted layer 16.

The aforementioned decorative material (FIG. 3) of the third invention comprises a decorative material substrate having a grain printed pattern inclusive of the first printed layer that consists of a delustering pattern having a color and a contour close to those of the grain trachea portion, a transparent or semitransparent delustering underprinted layer formed on the whole surface of the grain printed pattern of the decorative material substrate, and a second printed layer having a transparent or semitransparent lustering pattern formed on said delustering underprinted layer, the second printed layer being formed in such a manner that the outer contour thereof maintains a gap relative to the outer contour of the first printed layer in the horizontal direction and that the outer contour thereof is located on the first printed layer along the outer contour of the first printed layer, and said second printed layer being further so formed as to be greatly protruded beyond the first printed layer over the whole zones except the zone surrounded by the outer contour of the second printed layer positioned on the first printed layer via the delustering underprinted layer.

In the decorative material of the third invention constituted as described above, the trachea pattern portion is formed at a position corresponding to recessed portions in the surface of the decorative material, and the degree of delustering on the surface of the decorative material is varied depending upon the three portions, i.e., depending upon a portion where the delustering underprinted layer and the first printed layer are overlapped, a portion where the delustering underprinted layer and the second printed layer are overlapped, and a portion where the delustering underprinted layer, the first printed layer and the second printed layer are overlapped. Therefore, the decorative material exhibits high reality relative to the grain pattern of a natural tree and exhibits excellent design effects.

In the decorative material of the third invention, furthermore, a zone is formed on which the first printed layer and the second printed layer are overlapped on each other in the up-and-down direction. Therefore, even when the register of printing is deviated to some extent between the first printed layer and the second printed layer, no odd texture develops in the grain pattern of the decorative sheet and the design effects are not deteriorated. Therefore, a large allowance is offered to cope with deviation in the register of printing, and quality of the decorative material can be easily controlled during the production.

In the decorative material of the third invention, furthermore, the delustering underprinted layer is formed to cover the trachea pattern portions. Therefore, the delustering degree for the trachea pattern can be freely adjusted over a wide range, making it possible to obtain a variety kinds of decorative sheets to meet the demands.

Further, the decorative material of the third invention has a zone in which the second printed layer of a luster pattern is overlapped on the first printed layer inside the first printed layer along the outer contour of the first printed layer that exhibits grain tracheae. Therefore, the above zone is a contour zone of the first printed layer that exhibits the trachea; i.e., edge action of trachea pattern is exhibited and high design characters are exhibited, too.

The decorative material (FIG. 4) of the fourth invention comprises a decorative material substrate having a grain printed pattern inclusive of a first printed layer which consists of a delustering pattern having a color and a contour close to those of a grain trachea portion, a transparent or semitransparent delustering underprinted layer which is locally formed to cover the first printed layer of the decorative material substrate, and a second printed layer having a transparent or semitransparent lustering pattern which is formed from the delustering underprinted layer through up to the grain pattern on the decorative material substrate. The outer contour of the delustering underprinted layer is located on the grain printed pattern in the decorative material substrate along the outer contour of the first printed layer maintaining a gap relative to the outer contour of the first printed layer, the outer contour of the second printed layer is located on the first printed layer along the outer contour of the first printed layer maintaining a gap relative to the outer contour of the first printed layer in the horizontal direction. Further, the second printed layer is formed being greatly protruded beyond the first printed layer on the whole zones except the zone surrounded by the outer contour of the second printed layer positioned on the first printed layer via the delustering underprinted layer.

That is, the second printed layer in the decorative material of the fourth invention is formed such that its outer contour is located on the first printed layer in the vertical direction via the delustering underprinted layer, and so as to fill the gap between the delustering underprinted layers in the vertical direction.

In the decorative material of the fourth invention constituted as described above, the trachea pattern is imparted to a position corresponding to recessed portions in the surface of the decorative material, and the delustering on the surface of the decorative material is varied in four degrees, i.e., the degree of delustering is varied depending upon the four portions, i.e., depending upon a portion of the first printed layer which can be viewed through the delustering underprinted layer, a portion of the first printed layer which can be viewed through the second printed layer and the delustering underprinted layer, the underlayer pattern of grain printed pattern that can be viewed through the second printed layer only, and the underlayer pattern of grain printed pattern that can be viewed through the second printed layer and the delustering underprinted layer. Therefore, the decorative material exhibits high reality relative to the grain pattern of a natural tree and exhibits very high degree of design effects.

In the decorative material of the fourth invention, furthermore, the trachea pattern is covered with the delustering underprinted layer. Therefore, the delustering degree for the trachea pattern can be freely adjusted over a wide range, making it possible to obtain a variety kinds of decorative materials to meet the demands.

Moreover, the decorative material of the fourth invention has the first layer, the second printed layer and the delustering underprinted layer that are so formed that their outer contours do not meet each other but maintain a gap relative to each other. Therefore, even when the register of printing is deviated to some extent among these printed layers, no odd texture develops in the grain pattern and the design effects are not deteriorated, presenting large allowance to cope with deviation in the register of printing and enabling the quality to be easily controlled during the production.

Further, the decorative material of the fourth invention has a zone in which the second printed layer of a lustering pattern overlaps the first printed layer inside the first printed layer along the outer contour of the first printed layer that exhibits grain tracheae. Therefore, the above zone serves as a contour zone of the first printed layer that exhibits the trachea; i.e., edge action of trachea pattern is exhibited and high design characteristics are exhibited, too.

In the above-mentioned decorative material, furthermore, the ratio B/A of a distance B between the pair of second printed layers neighboring to each other via the first printed layer (distance from one outer contour to another outer contour) to the width A of the first printed layer, is set to lie within a range of from 0.1 to 0.9 to obtain high degree of design character very close to the grain pattern of a natural tree.

EXAMPLE C1

Referring to FIG. 5, a solid printed layer [SA produced by Showa Ink Co.] 2 was formed maintaining a thickness of 5 μm on a tissue paper of 30 g/m$^2$ [produced by Sanko Seishi Co.] 1 by the gravure printing method, and a grain printed pattern 3 inclusive of a first printed layer 5 consisting of vertically elongated trachea portion was formed by the gravure printing method using gravure printing inks of three colors [SAM produced by Showa Ink Co.] in order to obtain a decorative material substrate 4 composed of a starting paper for decorative sheet that has the grain printed pattern 3 with the trachea portion 5.

Then, a delustering underprinted layer 6 was formed by the gravure printing method using a two-liquid reaction curing polyurethane-type delustering clear ink [GBS Mat produced by Showa Ink Co.] maintaining a thickness of 5 μm on the whole surface of the grain printed pattern 3 of the starting paper 4 for decorative sheet, and a second printed layer 7 that forms a lustering pattern was formed maintaining a thickness of 5 μm by the trachea extract printing using a two-liquid reaction curing polyurethane-type luster clear ink [GBS Clear produced by Showa Ink Co.] on the delustering underprinted layer 6 on the whole zones except a zone **6*a* on the left side of the first printed layer 3 and a zone 6*b* of a vertically oblong shape continuous to the zone 6*a* of the left side, thereby to obtain a decorative material as designated at 8 in FIG. 5**.

In the above decorative material 8, the distance is about 5 μm from the surface of the second printed layer 7 to the surface of the delustering underprinted layer 6.

In the above decorative material 8, furthermore, the ratio B/A is from 1.2 to 1.4, where B denotes a distance from the outer contour of the second printed layer 7 to the outer contour of another second printed layer 7 neighboring to the above second printed layer 7 in the direction of width and A denotes a width of the first printed layer 5. Further, the ratio C/B is from 0.1 to 0.3, where B denotes a distance from the outer contour of the second printed layer 7 to the outer contour of another second printed layer 7 neighboring to the above second printed layer in the direction of width, and C denotes a width of a portion where the second printed layer 7 overlaps the first printed layer 5.

EXAMPLE C2

Figure 8:
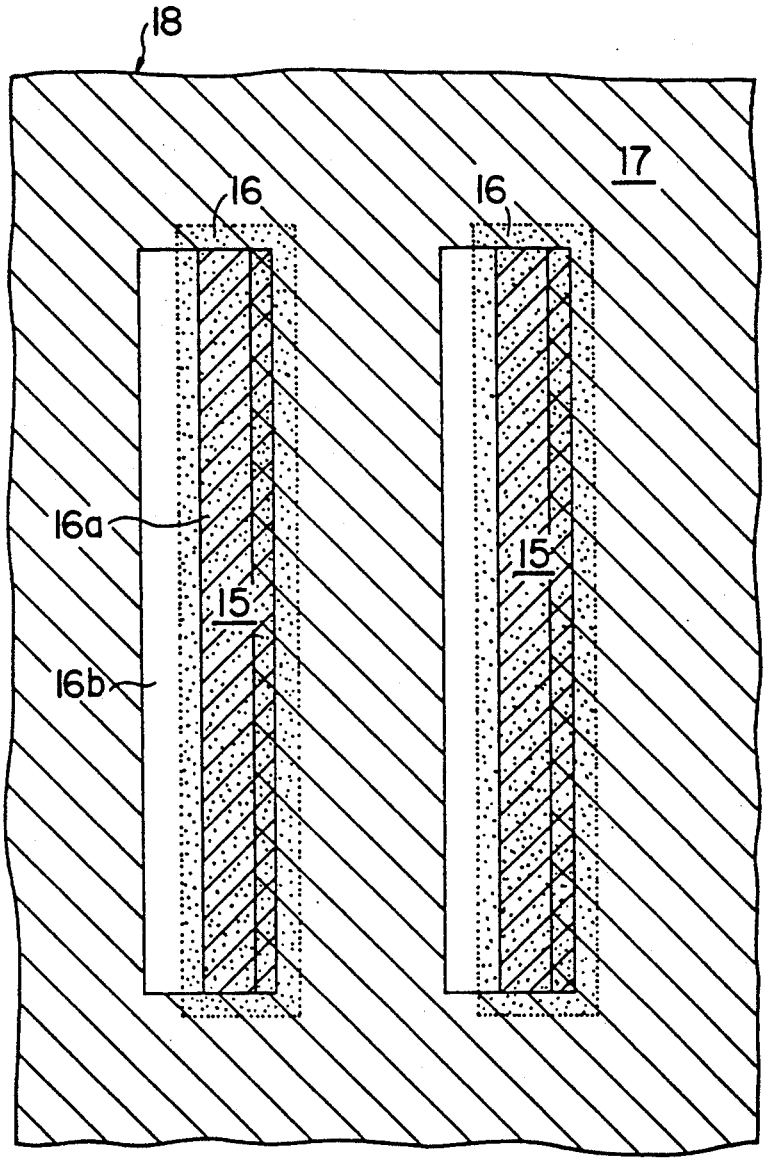

A decorative material substrate 14 having the same constitution as the starting paper 4 for decorative sheet of Example C1 was obtained. That is, a solid printed layer [SA of Showa Ink Co.] 12 was formed maintaining a thickness of 5 μm and grain printed pattern 13 inclusive of a vertically elongated trachea portion 15 that is a first printed layer was formed maintaining a thickness of 2 μm using gravure printing inks [SAM of Showa Ink Co.] both by the gravure printing method on a decorative material substrate 14 having the same structure as the starting paper 4 for decorative sheet of Example C1, i.e., on a tissue paper of 30 g/m$^2$ [Sanko Seishi Co.] 11 shown in FIGS. 6 and 8, in order to obtain a decorative material substrate 14 consisting of the starting paper for decorative sheet that has the grain printed pattern 13 with trachea portion 15.

Then, on the surface of the grain printed pattern 13 of the starting paper 14 for decorative sheet were locally formed delustering underprinted layers 16, 16 maintaining a thickness of 5 μm by the gravure printing method using a delustering clear ink [GBS Mat of Showa Ink Co.] in a manner that their outer contours were positioned along the outer contours of the first printed layers 15, 15 on the outside of the first printed layers 15, 15.

Then, a second printed layer 17 having a luster pattern was formed maintaining a thickness of 10 μm by the trachea removing printing using a luster clear ink [GBS Clear produced by Showa Ink Co.] on the whole zones except a zone **16*a* on the left side of the first printed layer 15 and a vertically elongated zone 16*b* that includes a portion which is continuous to the above zone 16*a* of the left side and which exceeds the zones of the delustering underprinted layers 16, 16, in order to obtain a decorative material as designated at 18 in FIG. 6**.

In the above-mentioned decorative material 18, the distance is 5 μm from the surface of the second printed layer 17 to the surface of the delustering underprinted layer 16, the ratio B/A is from 1.2 to 1.4 where A denotes the width of the first printed layer 15 and B denotes the distance from the outer contour of the second printed layer 17 to the outer contour of another second printed layer 17 that is neighboring to the above second printed layer 17 in the direction of width, the ratio C/B is from 0.1 to 0.3 where B denotes the distance from the outer contour of the second printed layer 17 to the outer contour of another second printed layer neighboring to the above second printed layer 17 in the direction of width and C denotes the width of a portion where the first printed layer 15 overlaps the second printed layer 17, and a portion in which the delustering underprinted layer 16 extends relative to the first printed layer 15 has a distance in straight line of 200 to 500 μm.

The decorative material (FIG. 5) of the fifth invention comprises a decorative material substrate having a grain printed pattern inclusive of a vertically elongated first printed layer that expresses the grain trachea portion, a transparent or semitransparent delustering underprinted layer formed on the whole surface of the grain printed pattern in the decorative material substrate, and a second printed layer having a transparent or semitransparent luster pattern formed on the transparent or semitransparent delustering underprinted layer, the second printed layer being formed on all zones except a zone on either the right side or the left side of the vertically elongated first printed layer and a vertically elongated zone continuous to the above zone in the direction of width and protruding greatly beyond the delustering underprinted layer.

In the decorative material of the fifth invention constituted as described above, the trachea pattern portion is formed spanning from the recessed portion to the protruded portion on the surface of the decorative material. Therefore, one side of the trachea portion which is not covered with the second printed layer gives the expression of a deeper trachea pattern. Furthermore, the delustering on the surface of the decorative material is varied in four degrees depending upon the four portions, i.e., depending upon a portion where the second printed layer overlaps the first printed layer, a portion where the first printed layer can be viewed through the delustering underprinted layer, a portion where the grain printed pattern other than the first printed layer can be viewed through the delustering underprinted layer, and a portion where the grain printed pattern other than the first printed layer can be viewed through the second printed layer. Therefore, the decorative material exhibits high reality relative to the grain pattern of a natural tree and exhibits excellent design effects.

In the decorative material of the fifth invention, furthermore, either a zone in which the underlying grain printed pattern is exposed or a zone where the second printed layer overlaps the first printed layer, is provided between the first printed layer and the second printed layer. Therefore, even when the register of printing is deviated to some extent between the first printed layer and the second printed layer in the horizontal direction, no odd texture develops in the grain pattern and the design effects are not deteriorated, presenting large allowance to cope with deviation in the register of printing and enabling the quality to be easily controlled during the production.

Further, the decorative material of the fifth invention has the delustering underprinted layer that covers the trachea pattern. Therefore, the delustering degree of the trachea pattern can be freely varied over a wide range making it possible to obtain a variety kinds of decorative materials to meet the demands.

The decorative material of the sixth invention (FIG. 6) comprises a decorative material substrate having a grain printed pattern inclusive of a vertically elongated first printed layer that expresses the grain trachea portion, a transparent or semitransparent delustering underprinted layer locally formed on the grain printed pattern in the decorative material substrate so as to cover the first printed layer along the outer contour of the first printed layer on the outside of the first printed layer, and a second printed layer having a transparent or semitransparent luster pattern which is formed on the transparent or semitransparent delustering underprinted layer spanning onto the grain printed pattern on the decorative material substrate. In the decorative material of the sixth invention, the second printed layer is formed on the whole zones except a zone on either the right side or the left side of the elongated first printed layer and a vertically elongated zone which is continuous to the above zone in the direction of width and which includes a portion that exceeds the zone of the transparent or semitransparent delustering underprinted layer, the second layer greatly protruding beyond the delustering underprinted layer.

In the decorative material of the sixth invention constituted as described above, the trachea pattern portion is formed spanning from the recessed portion to the protruded portion on the surface of the decorative material. Therefore, one side of the trachea portion which is not covered with the second printed layer gives the expression of a deeper trachea pattern. Furthermore the delustering on the surface of the decorative material is varied in five degrees depending upon the five portions, i.e., depending upon a portion where the first printed layer, the second printed layer and the delustering underprinted layer are overlapped, a portion where the second printed layer overlaps the delustering underprinted layer, a portion where the grain printed pattern other than the first printed layer can be viewed via the second printed layer, a portion where the grain printed pattern other than the first printed layer can be viewed through the delustering underprinted layer, and a portion where the grain printed pattern other than the first printed layer is exposed. Therefore, the decorative material exhibits high reality relative to the grain pattern of a natural tree and exhibits excellent design effects.

In the decorative material of the sixth invention, furthermore, the first printed layer and the second printed layers have outer contour lines that are deviated from each other in the direction of plane. Therefore, even when the aim of printing is to some extent in the horizontal direction, no odd texture develops in the grain pattern and the design effects are not deteriorated, presenting large allowance to cope with deviation in the aim of printing and enabling the quality to be easily controlled during the production.

Further, the decorative material of the sixth invention has the delustering underprinted layer that covers the trachea pattern portion. Therefore, the delustering degree of the trachea pattern can be freely varied over a wide range making it possible to obtain a variety kinds of decorative materials to meet the demands.

In the decorative material of the present invention, the ratio B/A is set to 0.1 to 2.0 where A denotes the width of the first printed layer and B denotes the distance from the outer contour line of the second printed layer to the outer contour line of another second printed layer neighboring to the above second printed layer in the direction of width, i.e., B denotes the width of the zone where no second printed layer is formed. Further, the ratio C/B is set to lie within a range of from 0.1 to 0.9 where B denotes the distance from the outer contour of the second printed layer to the outer contour of the another second printed layer neighboring to the above second printed layer in the direction of width and C denotes the width of a portion where the second printed layer overlaps the first printed layer at a side portion. Therefore, the decorative material exhibits high design effects very close to the trachea pattern of a natural tree.

EXAMPLE D1

Referring to FIG. 9, a solid printed layer [SA produced by Showa Ink Co.] 2 was formed maintaining a thickness of 3 μm by the gravure printing method on a tissue paper of 30 g/m$^2$ [produced by Sanko Seishi Co.], and a grain printed pattern 3 inclusive of a first printed layer 5 consisting of a trachea portion was formed by the gravure printing method using gravure printing inks of three colors [SAM of Showa Ink Co.] in order to obtain a starting paper 4 for decorative sheet having the grain printed pattern 3 with the trachea portion 5, i.e., in order to obtain a decorative material substrate 4 having the grain printed pattern 3 with the trachea portion 5.

Then, a delustering underprinted layer 6 was formed by the gravure printing method maintaining a thickness of 2 μm using a two-liquid reaction curing polyurethane-type delustering clear ink [GBS Mat produced by Showa Ink Co.] on the whole surface of the grain printed pattern 3 of the decorative material substrate 4, and a second printed layer 7 that forms a luster pattern was formed maintaining a thickness of 5 μm by the trachea removing printing using a two-liquid reaction curing polyurethane-type clear ink [GBS Clear produced by Showa Ink Co.] on the delustering underprinted layer 6 based on the gravure printing method on the whole zones except the zones of the first printed layers 5, 5, thereby to obtain a decorative material as designated at 8 in FIG. 9.

The distance is 5 μm from the surface of the second printed layer 7 to the surface of the delustering underprinted layer 6.

EXAMPLE D2

A decorative material substrate 14 having the same constitution as the decorative material substrate 4 of Example D1 was obtained. That is, a solid printed layer [SA of Showa Ink Co.] 12 was formed maintaining a thickness of 2 μm and a grain printed pattern 13 inclusive of a trachea portion 15 which is the first printed layer was formed using gravure printing inks of three colors [SAM produced by Showa Ink Co.] both by the gravure printing method on a tissue paper of 30 g/m$^2$ [Sanko Seishi Co.] 11, in order to obtain a decorative material substrate 14 having a grain printed pattern 13 with trachea portions 15, 15.

Then, on the surface of the grain printed pattern 13 of the decorative material substrate 14 were locally formed delustering underprinted layers 16, 16 maintaining a thickness of 2 μm by the gravure printing method using a two-liquid reaction curing polyurethane-type deluster clear ink [GBS Mat produced by Showa Ink Co.] in a manner that the first printed layers 15, 15 were completely covered and that the outer contours thereof extend along the outer contours of the first printed layers 15, 15 on the outside of the first printed layers 15, 15.

Then, second printed layers 17, 17 were formed maintaining a thickness of 10 μm by the two-liquid reaction curing polyurethane-type luster clear ink [GBS Clear produced by Showa Ink Co.] and by the trachea extract printing based on the gravure printing method in a manner that the outer contours came into agreement with the outer contours of the first printed layers 15, 15 via the delustering underprinted layer 16 on the whole zones except the zone of the first printed layers 15, 15, in order to obtain a decorative material designated at 18 in FIG. 10.

The distance was about 8μ from the surface of the second printed layer 17 to the surface of the delustering underprinted layer 16.

Further, the distance was from 100 to 2000 μm in straight line from the outer contour of the first printed layer 15 to the outer contour of the delustering underprinted layer 16 in the decorative material 18.

In the decorative material (FIG. 9) of the seventh invention, the pattern imparted to the surface of the decorative material substrate consists of a grain printed pattern inclusive of the first printed layer that has a color and a contour close to those of the grain trachea portion, a transparent or semitransparent delustering underprinted layer formed on the whole surface of the grain printed pattern, and a second printed layer that forms a transparent or semitransparent luster pattern formed on the delustering underprinted layer, and wherein the second printed layer is formed on the whole zones except the zone of the first printed layer in a manner that the outer contour thereof overlaps the outer contour of the first printed layer and the second printed layer being greatly protruded beyond the delustering underprinted layer.

In the decorative material of the seventh invention constituted as described above, the trachea pattern portion is formed at a position corresponding to the recessed portion in the surface of the decorative material, and the delustering degree on the surface of the decorative material is expressed based on the combination of the delustering underprinted layer and the first printed layer and is varied over a wide range. That is, the delustering is exhibited in very high degrees, making it possible to obtain decorative material of high design effects having a variety of degrees of delustering to meet the demands.

In the decorative material of the seventh invention, the first printed layer and the second printed layer are so formed that they will not overlap on each other in the up-and-down direction, and a transparent or semitransparent underprinted layer is interposed between the second printed layer and the first printed layer. Therefore, even when the register of printing is deviated to some extent between the outer contour of the first printed layer and the outer contour of the second printed layer, no odd texture develops in the grain pattern of the decorative material and the design effects are not deteriorated, presenting large allowance to cope with deviation in the register of printing and enabling the quality to be easily controlled during the production.

In the decorative material (FIG. 10) of the eighth invention, the pattern imparted to the surface of the decorative material substrate consists of a grain printed pattern inclusive of the first printed layer that has a color and a contour close to those of the trachea conduit portion, a transparent or semitransparent delustering underprinted layer that is locally formed to completely cover the first printed layer along the outer contour of the first printed layer outside the first printed layer, and a second printed layer that forms a transparent or semitransparent luster pattern formed on the delustering underprinted layer through up to the grain printed pattern, the second printed layer being formed on the whole zones except the zone of the first printed layer in a manner that the outer contour thereof overlaps the outer contour of the first printed layer in the vertical direction, and the second printed layer being greatly protruded beyond the delustering underprinted layer.

That is, in the decorative material of the eighth invention, the second printed layer is so formed that the outer contour thereof is positioned on the outer contour of the first printed layer in the vertical direction via the delustering underprinted layer but does not overlap the first printed layer in the vertical direction.

In the decorative material of the eighth invention constituted as described above, the trachea pattern is imparted to a position corresponding to recessed portions in the surface of the decorative material, and the delustering on the surface of the decorative sheet is varied in three degrees depending upon the three portions, i.e., depending upon a portion where the first printed layer can be viewed through the delustering underprinted layer, a portion of the underlying grain printed pattern that can be viewed through the second printed layer and the delustering underprinted layer, and an underlying pattern of grain printed pattern that can be viewed through the second printed layer. Therefore, the decorative material exhibits high reality relative to the grain pattern of a natural tree and exhibits very high degree of design effects.

In the decorative material of the eighth invention, furthermore, the trachea pattern is covered with the delustering underprinted layer. Therefore, the delustering degree for the trachea pattern can be freely varied over a wide range, making it possible to obtain a variety kinds of decorative materials to meet the demands.

In the decorative material of the eighth invention, the first printed layer and the second printed layer are formed so as not to be overlapped on each other in the up-and-down direction. Moreover, a transparent or semitransparent delustering underprinted layer is interposed in a portion where the outer contour of the second printed layer overlaps the outer contour of the first printed layer. Therefore, even when the register of printing is deviated to some extent between the outer contour of the first printed layer, and the outer contour of the second printed layer, no odd texture develops in the grain pattern of the decorative material and the design effects are not deteriorated, presenting large allowance to cope with deviation in the register of printing and enabling the quality to be easily controlled during the production.

In the decorative material of the eighth invention, furthermore, the first printed layer, the second printed layer and the delustering underprinted layer are so formed that their outer contours will not overlap but maintain gaps relative to each other. Therefore, even when the register of printing is deviated to some extent among these printed layers, no odd texture develops in the grain pattern and the design effects are not deteriorated, presenting large allowance to cope with deviation in the register of printing and enabling the quality to be easily controlled during the production.

In the decorative material of the eighth invention as described above, a zone is formed in which the second printed layer forming a luster pattern overlaps the delustering underprinted layer along the outer contour of the first printed layer that represents the grain trachea on the outside of the first printed layer. Therefore, the above zone serves as a contour zone of the first printed layer that exhibits the trachea, and edge action of trachea pattern is exhibited to produce high design character.

We claim:

1. A decorative material comprising:

a decorative material substrate having a grain printed pattern inclusive of a first printed layer that has a color and a contour close to those of grain tracheae;

a transparent or semitransparent delustering layer formed on the whole surface of said grain printed pattern of said decorative material substrate; and a second printed layer consisting of a transparent or semitransparent lustering pattern formed on said delustering layer except the zones of said first printed layer in the vertical direction in a manner that the outer contour thereof is located along the outer contour of said first printed layer maintaining a gap relative to the outer contour of said first printed layer, said second printed layer being protruded beyond said delustering layer.

2. A decorative material comprising:

a decorative material substrate having a grain printed pattern inclusive of a first printed layer that has a color and a contour close to those of grain tracheae;

a transparent or. semitransparent delustering layer which is locally formed to completely cover said first printed layer in a manner that the outer contour thereof is located along the outer contour of said first printed layer maintaining a gap relative to the outer contour of said first printed layer in the horizontal direction; and a second printed layer consisting of a transparent or semitransparent lustering pattern, said second printed pattern having an outer contour which is located on said delustering layer along the outer contour of said first printed layer maintaining a gap relative to the outer contour of said first printed layer in the horizontal direction, said second printed layer being formed on said delustering layer except the zones of said first printed layer in the vertical direction, and said second printed layer protruding beyond said delustering layer.

3. A decorative material according to claims 1 or 2, wherein a ratio B/A of a distance B between the second printed layers neighboring to each other via the first printed layer, the distance from one outer contour to another outer contour, to a width A of said first printed layer lies within a range of from 1.1 to 2.0.

4. In a decorative material comprising a decorative material substrate having a grain printed pattern inclusive of a first printed layer that forms a luster pattern of a color and a contour close to those of grain tracheae, a transparent or semitransparent delustering layer formed on the whole surface of said grain printed pattern in said decorative material substrate, and a second printed layer having a transparent or semitransparent lustering pattern formed on said delustering layer, the improvement wherein the outer contour of said second printed layer is located on said first printed layer along the outer contour of said first printed layer maintaining a gap relative to the outer contour of said first printed layer, and said second printed layer is formed on the delustering layer except a zone surrounded by the outer contour of the second printed layer that is located on said first printed layer via said delustering layer, said second printed layer being protruded beyond said first printed layer.

5. In a decorative material comprising a decorative material substrate having a grain printed pattern inclusive of a first printed layer that forms a luster pattern of a color and a contour close to those of grain tracheae, a transparent or semitransparent delustering layer locally formed to cover said first printed layer in said decorative material substrate, and a second printed layer having a transparent or semitransparent lustering pattern formed on said delustering layer through up to the grain pattern in said decorative material substrate, the improvement wherein the outer contour of said delustering layer is located on the grain printed pattern in said decorative material maintaining a gap relative to the outer contour of said first printed layer and along the outer contour of said first printed layer, the outer contour of said second printed layer is located on said first printed layer maintaining a gap relative to the outer contour of said first printed layer and along the outer contour of said first printed layer in the horizontal direction, said second printed layer being formed on the delustering layer except a zone surrounded by the outer contour of said second printed layer which is located on said first printed layer via said delustering layer, and said second printed layer protruding beyond said first printed layer.

6. A decorative material according to claims 4 or 5, wherein the ratio B/A of a distance B between the contours of the second printed layers on the first printed layer to a width A of said first printed layer is from 0.1 to 0.9.

7. A decorative material comprising:

a decorative material substrate having a grain printed pattern inclusive of a first printed layer of a vertically elongated shape to express a grain trachea portion;

a transparent or semitransparent delustering layer formed on the whole surface of said grain printed pattern of said decorative material substrate; and a second printed layer consisting of a transparent or semitransparent lustering pattern formed on said transparent or semitransparent delustering layer, said second printed layer being formed on the delustering layer except a zone on either the right side or the left side of said vertically elongated first printed layer and a zone continuous to said zone in the direction of width, and said second printed layer protruding beyond said delustering layer.

8. A decorative material comprising:

a decorative material substrate having a grain printed pattern inclusive of a first printed layer of a vertically elongated shape to express a grain trachea portion;

a transparent or semitransparent delustering layer locally formed on said grain printed pattern of said decorative material substrate to cover said first printed layer, the outer contour of said delustering layer being located along the outer contour of said first printed layer on the outside of said first printed layer; and a second printed layer consisting of a transparent or semitransparent lustering pattern formed on said transparent or semitransparent delustering layer through up to the grain printed pattern on the decorative material substrate, said second printed layer being formed on the delustering layer except a zone on either the right side or the left side of said vertically elongated first printed layer and a zone that is continuous to said zone in the direction of width and that includes a that exceeds the zone of said transparent or semitransparent delustering layer, said second protruding beyond said delustering layer.

9. A decorative material according to claims 7 or 8, wherein the ratio B/A is from 0.1 to 2.0 where A denotes a width of the printed layer and B denotes a distance from the outer contour of said second printed layer to the outer contour of another second printed layer neighboring to said second printed layer in the direction of width, and the ratio C/B is from 0.1 to 0.9 where B denotes a distance from the outer contour of the second printed layer to the outer contour of another second printed layer neighboring to said second printed layer in the direction of width and C denotes a width of a portion where the second printed layer overlaps the first printed layer.

10. A decorative material comprising:

a decorative material substrate having a grain printed pattern inclusive of a first printed layer that has a color and a contour close to those of grain tracheae;

a transparent or semitransparent delustering layer formed on the whole surface of said grain printed pattern of said decorative material substrate; and a second printed layer consisting of a transparent or semitransparent lustering pattern formed on said delustering layer, said second printed layer being formed on the delustering layer except a zone of said first printed layer in a manner that the outer contour thereof overlaps the outer contour of said first printed layer in the vertical direction, and said second printed layer protruding beyond said delustering layer.

11. A decorative material comprising:

a decorative material substrate having a grain printed pattern inclusive of a first printed layer that has a color and a contour close to those of grain tracheae;

a transparent or semitransparent delustering layer locally formed to completely cover said first printed layers in a manner that the outer contour thereof is located along the outer contour of said first printed layer on the outside of said first printed layer; and a second printed layer consisting of a transparent or semitransparent lustering pattern formed on said delustering layer through up to the grain printed pattern of the decorative material substrate, said, second printed layer being formed on the delustering layer except a zone of said first printed layer in a manner that the outer contour thereof overlaps the outer contour of said first printed layer, and said second printed layer protruding beyond said delustering layer.

* * * * *